United States Patent [19]

Stritzl et al.

[11] Patent Number: 4,758,017

[45] Date of Patent: Jul. 19, 1988

[54] SAFETY SKI BINDING

[75] Inventors: Karl Stritzl; Henry Freisinger, both of Vienna, Austria

[73] Assignee: TMC Corporation, Baar/Zug, Switzerland

[21] Appl. No.: 914,874

[22] Filed: Oct. 3, 1986

[30] Foreign Application Priority Data

Oct. 3, 1985 [AT] Austria ..... 2856/85

[51] Int. Cl.[4] ..... A63C 9/08

[52] U.S. Cl. ..... 280/618; 280/626; 280/634

[58] Field of Search ..... 280/617, 618, 626, 628, 280/634

[56] References Cited

U.S. PATENT DOCUMENTS

| | | | |
|---|---|---|---|
| 4,421,341 | 12/1983 | Krob et al. | 280/628 |
| 4,444,413 | 4/1984 | Richert et al. | 280/632 |
| 4,607,859 | 8/1986 | Wittmann et al. | 280/632 |
| 4,625,991 | 12/1986 | Leichtfried | 280/632 |
| 4,681,338 | 7/1987 | Spitaler | 280/628 |

FOREIGN PATENT DOCUMENTS

| | | | |
|---|---|---|---|
| 3102010 | 9/1982 | Fed. Rep. of Germany | 280/628 |

*Primary Examiner*—David M. Mitchell
*Assistant Examiner*—Brian L. Johnson
*Attorney, Agent, or Firm*—Flynn, Thiel, Boutell & Tanis

[57] ABSTRACT

A safety ski binding including a sole plate pivotally supported on a ski-fixed pivot pin in a horizontal plane, however, is secured against lifting off from the ski. A front jaw is provided on the sole plate at its front end and a heel holder at its rear end. A housing is provided and includes a sole holder pivotally supported for movement about a transversely extending axle against the force of at least one spring and which carries a roller loaded by a further spring on a control lever. The roller is associated with a curved surface mounted on a ski-fixed member and controlling the lateral pivoting of the sole plate, whereby one of the springs is nested coaxially into the other in the housing and the housing is secured on the sole plate extension members.

8 Claims, 6 Drawing Sheets

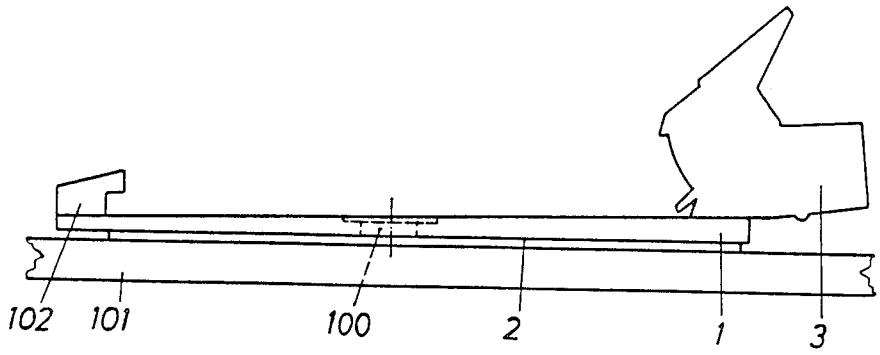
FIG. 1
FIG. 2
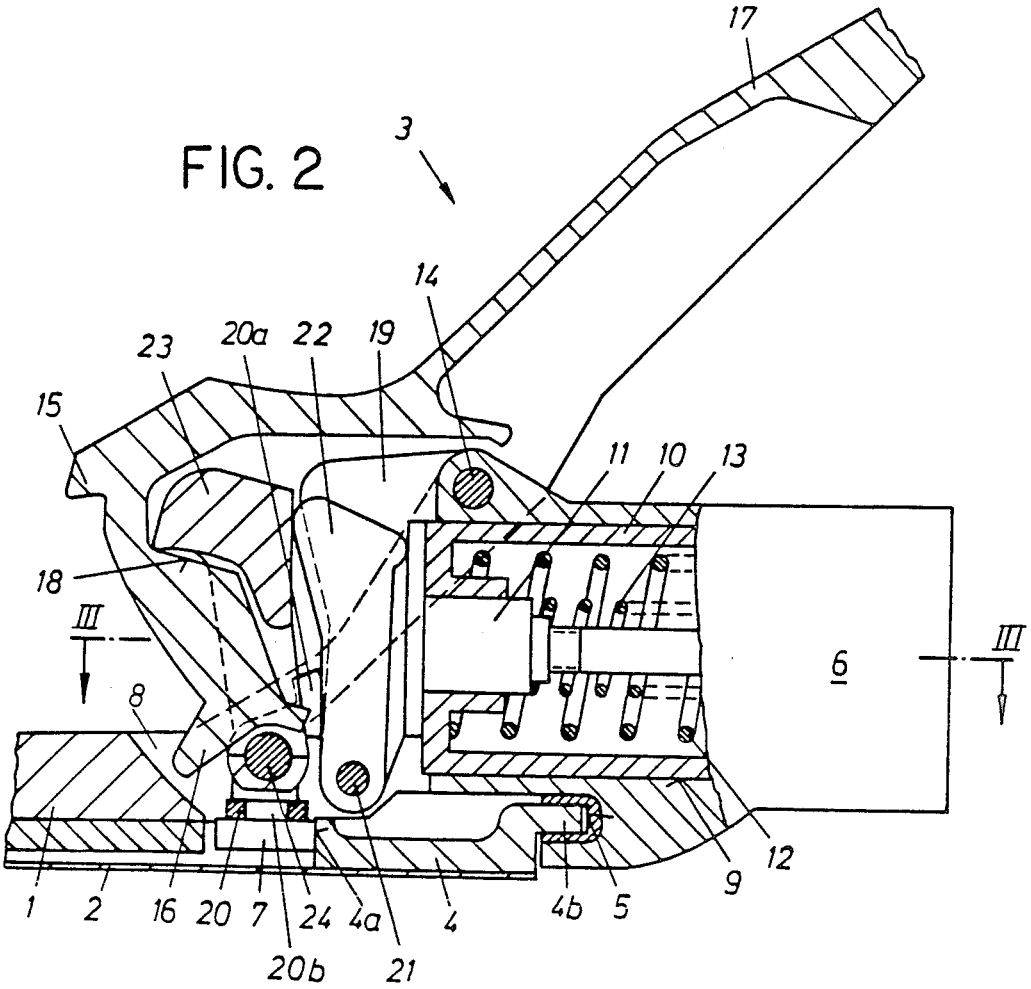

SAFETY SKI BINDING

FIELD OF THE INVENTION

The invention relates to a safety ski binding having a sole plate which is pivotally supported on a ski-fixed pivot pin and has a front jaw at one end and a heel holder at the other end.

BACKGROUND OF THE INVENTION

A known construction of this type, which is described in German OS No. 31 02 010, uses two pairs of toggle levers to lock the sole holder in the skiing position. However, these toggle levers are difficult to install. Furthermore, the known heel holder is relatively complicated in its design.

The purpose of the invention is to overcome the disadvantages of the known construction and to provide a safety ski binding which can be manufactured and installed easily.

Starting out from a safety ski binding set forth in the Field of the Invention, this purpose is attained inventively by providing two springs in a single bore in a housing and having a transversely extending axle on either the housing or an extension member oriented above the two springs for hingedly supporting an intermediate member, which in the area of its lower end has a further transversely extending axle on which is supported an intermediate lever, the intermediate lever being pressed by both springs against a conventional locking lever supported on a further cam surface provided on the inside of the sole holder, the locking lever being supported on the extension member on another transversely extending axle. A particular advantage of this construction lies in the locking lever, which pivots during a frontal fall, being loaded by both springs, whereas the roller for facilitating a release in a plane parallel to the upper side of the ski is pressed against the cam surface by only one spring. One of the two springs therefore must perform a double function.

BRIEF DESCRIPTION OF THE DRAWINGS

Two exemplary embodiments of the subject matter of the invention are purely schematically illustrated in the drawings, in which:

FIG. 1 is a side view of the entire safety ski binding;

FIG. 2 is a vertical longitudinal cross-sectional view of the rear end of the ski binding which is in the skiing position according to a first embodiment;

DETAILED DESCRIPTION

Figure 3:
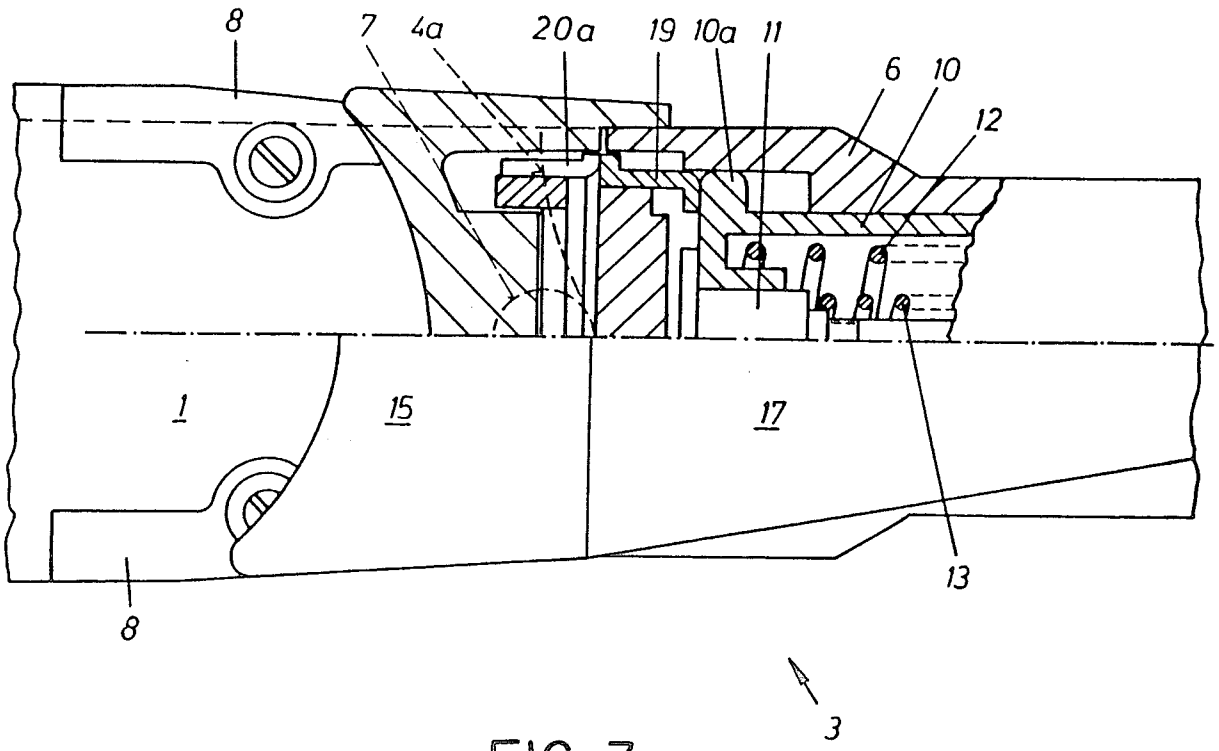
FIG. 3 is a partially sectioned top view taken along the line III—III of FIG. 2 of the rear end of the ski binding.

The safety ski binding illustrated in FIGS. 1 to 5 is a so-called plate binding. It has a sole plate 1, which can be pivoted about a ski-fixed pivot pin 100 in a horizontal plane. A base plate 2, which carries the pivot pin 100 is provided on the ski 101. A front jaw 102 is secured at the front end of the sole plate 1, which front jaw is not the subject matter of the present invention. The rear end of the sole plate 1 carries a heel holder which in its entirety is identified by the reference numeral 3 (See FIG. 1).

A member 4 is furthermore secured to the base plate, which member has a cam surface 4*a* on its side facing the pivot pin 100. The member 4 has a rib 4*b* on a side opposite the cam surface 4*a*, which rib 4*b* is received in a groove 5 in the front facing side of the housing 6 of the heel holder 3, which groove 5 is circular in the top view. Of course, the pivot pin is the centerpoint for the circular arc of the groove 5. A gap for a roller 7 is provided between the member 4 and the sole plate 1.

A pair of laterally spaced and symmetrically oriented extensions 8 are secured to the upper surface of the rear end portion of the sole plate 1 and extend parallel rearwardly from the sole plate 1. The housing 6 of the heel holder 3 is positioned between the extensions 8, which are fastened by screws to the sole plate 1. Furthermore, a bore 9 is provided in the housing 6, which bore extends parallel with respect to the upper side of the ski and in longitudinal direction of the ski: The bore 9 houses, on the one hand, a reciprocal piston 10 responsive to pivotal movement of the sole plate 1 which is provided with two laterally extending shoulders 10*a* and, on the other hand, a further piston 11, which is guided in a bore in the piston 10. The piston 10 is loaded or biassed toward the front of the ski (left in FIG. 1) by a first spring 12, the initial tension of which can be adjusted in a conventional manner. Coaxially with respect to the first spring 12, there is provided a second spring 13, which acts onto the piston 11. The initial tension of the spring 13 can also be adjusted.

A transversely extending crossbore, in which an axle 14 is supported, is provided above the bore 9. A unit, consisting of a sole holder 15, a stepping spur 16 and a release lever 17, is hingedly secured to the axle 14. The unit has a cam surface 18 on an inside portion thereof. Furthermore, an intermediate member 19 is supported near its top on the axle 14. The intermediate member 19 is supported on one side thereof on the face of the piston 10 (see FIG. 3), and carries an axle 21 near its bottom. An intermediate lever is supported on the axle 21, which on the one side thereof rests on an inner piston 11 concentric with the piston 10 and on the other side thereof on a one-arm locking lever 23. The locking lever 23 is pivotally supported on an axle 24, which extends through the extensions 8 secured to the sole plate 1. A two-arm control lever 20 is also pivotally supported on the axle 24.

The two-arm control lever 20 rests with extensions 20*a* on the intermediate member 19. The control lever 20 furthermore has a downwardly projecting axle 20*b* on which the roller 7 is supported. The sole holder 15 is held in the skiing position by the first spring 12 and the second spring 13. The cam surface 4*a* is constructed approximately V-shaped, so that in the skiing position, the roller 7 yieldably holds the sole plate 1 under the influence of the spring 12, in alignment with the longitudinal axis of the ski.

Figure 4:
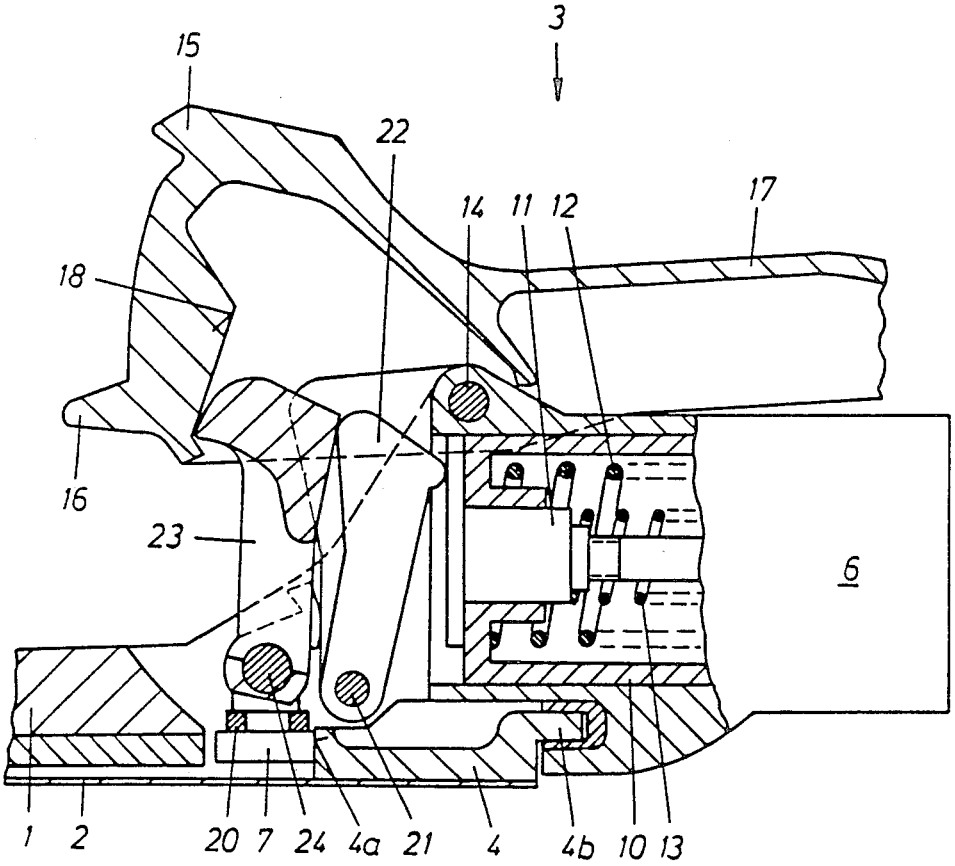
FIG. 4 is a vertical longitudinal cross-sectional view of the heel holder in the open position after a frontal fall.
Figure 5:
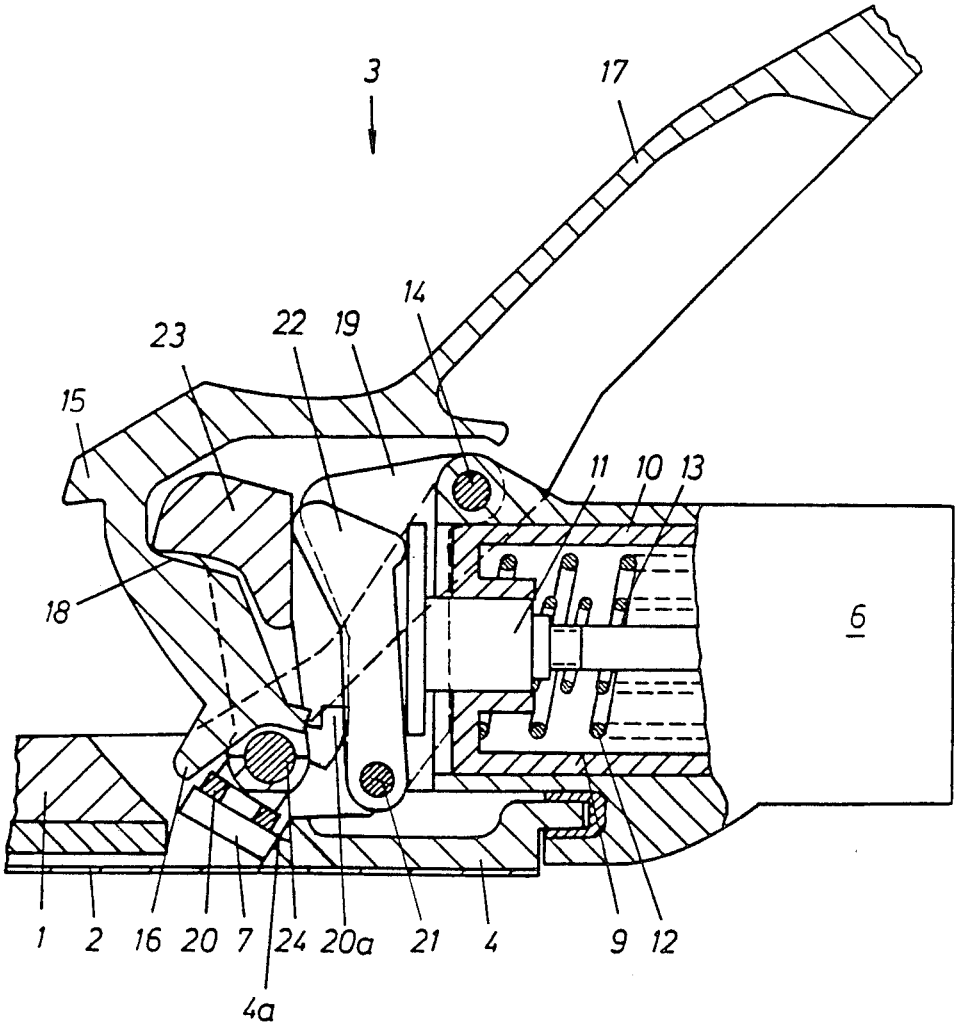
FIG. 5 is the same cross-sectional view after a twisting fall.

If a frontal fall of the skier occurs during skiing, the springs 12 and 13 are compressed, and the unit including the sole holder 15, stepping spur 16 and release lever 17 pivots clockwise in FIG. 2, which results in a release of the ski shoe (see FIG. 4). The free end of the locking lever 23 slides along the cam surface 18 and undergoes a return movement due to the action thereon by the intermediate lever 22 and the two pistons 10 and 11.

However, if a pure twisting fall of the skier occurs during skiing (see FIG. 5), then the roller 7 rolls along the cam surface 4*a* due to a pivoting or rotating movement of the sole plate 1 about the pivot pin, so that through the control lever 20 and the intermediate lever 22 only the rotation responsive piston 10 is moved to the right in FIG. 2 and thus only the spring 12 is compressed.

Since, however, the intermediate member 19 carrying the axle 21 lies between the control lever 20 and the piston 10, this axle wanders also slightly to the right during a lateral pivotal movement.

A release of the sole holder 15 does not occur on the sole holder 3 during a pure twisting fall. The spring 12, however, is in this case already slightly compressed, so that the sole holder 15 is loaded only by the second spring 13, which makes a release of the ski shoe easier.

The two operations are superposed during a combined fall. Both springs 12, 13 are thereby of course compressed.

The release lever 17 is pivoted clockwise during a voluntary release. The end of the locking lever 23 slides thereby along the cam surface 18, which results in a compression of the two springs 12 and 13. As soon as the release point of the heel holder 3 has been reached, the release lever 17 automatically swings into the open position.

Figure 6:
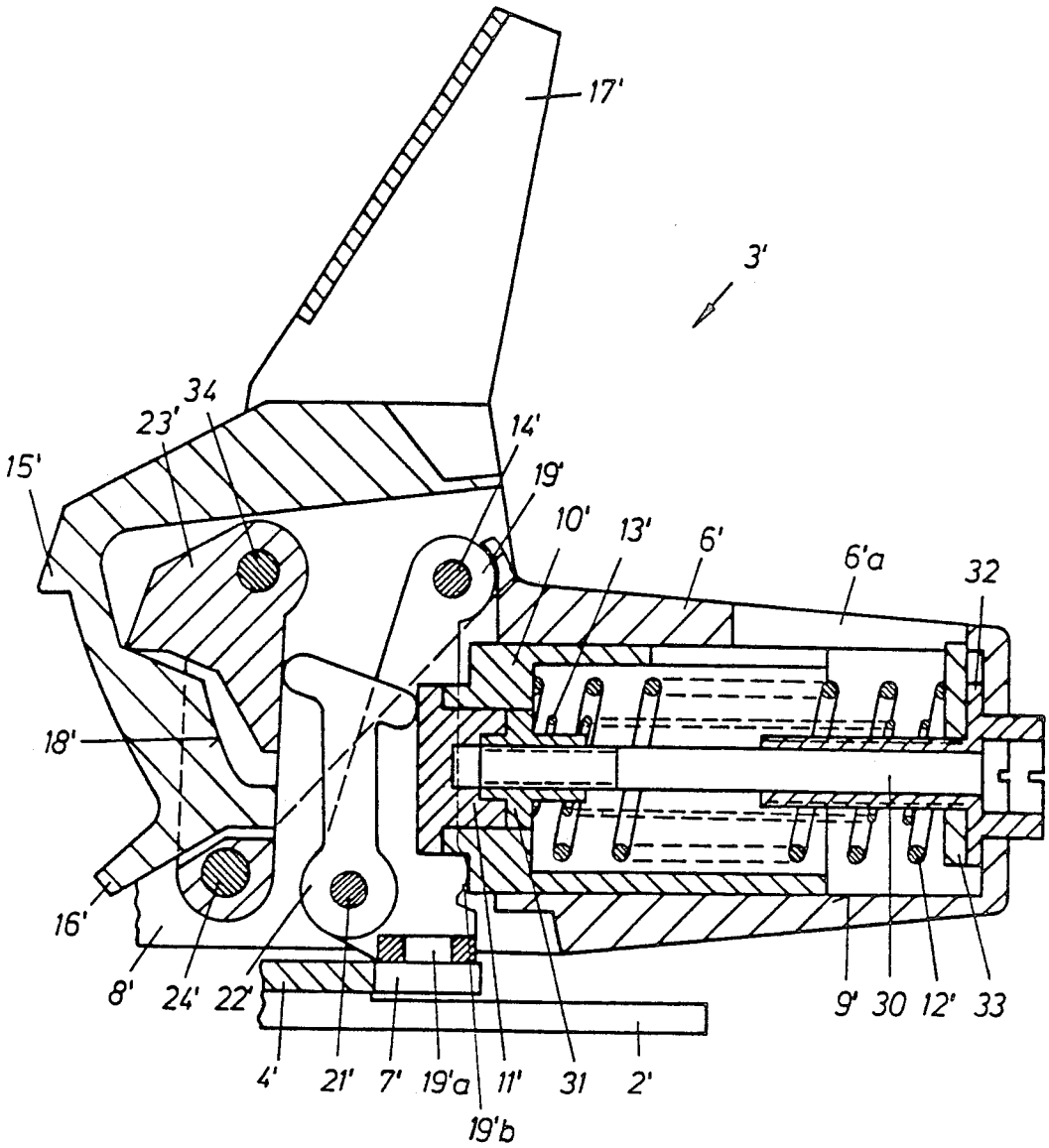
FIGS. 6 and 7 finally illustrate a longitudinal cross-sectional view and an illustration corresponding with FIG. 3, respectively, of a further embodiment in the skiing position.
Figure 7:
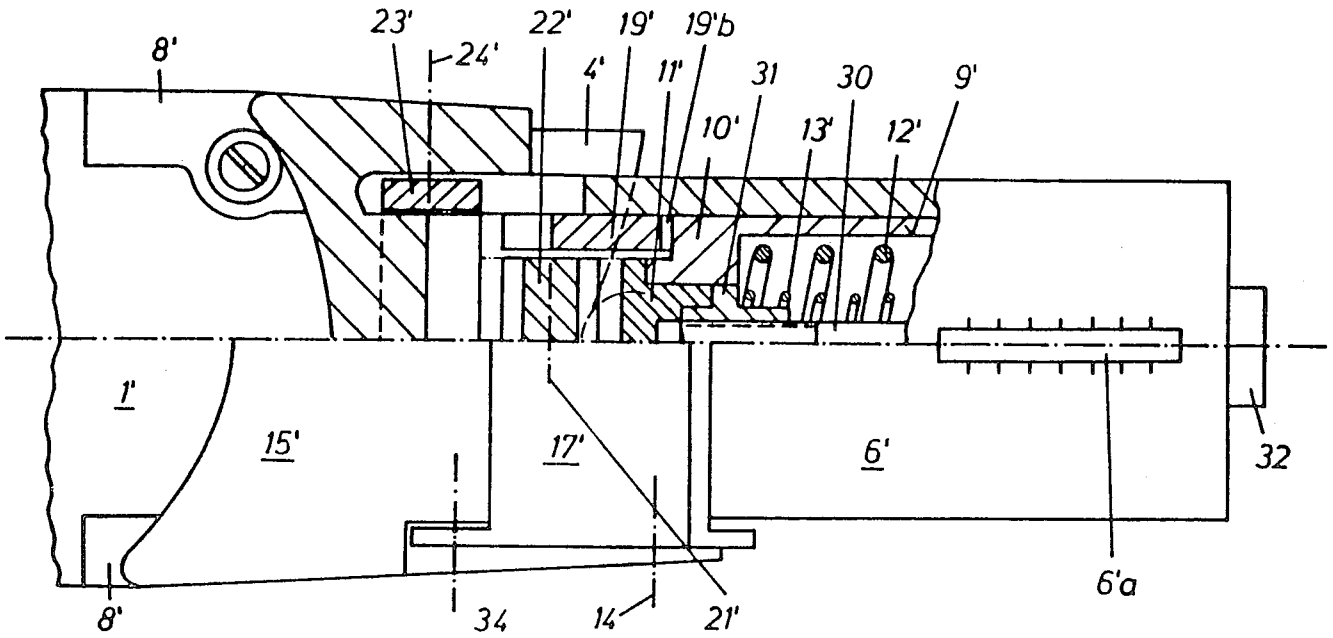

The design of a heel holder 3' according to FIGS. 6 and 7 is similar to the first described exemplary design. The heel holder 3' also includes a pair of parallel extending extensions 8' secured by screws to the sole plate 1, between which a housing 6' is secured. A bore 9' extending parallel with respect to the upper side of the ski and extending in longitudinal direction of the ski is provided in the housing 6'. A rotation responsive piston 10' is reciprocally guided and prevented from rotating in the bore 9'. A further piston 11' is guided in a central bore in the piston 10'. Each piston 10' and 11' is loaded by a pressure spring 12' and 13', respectively. The springs 12' and 13' are nested coaxially into one another. The initial tension of the spring 13' is adjusted by means of a screw 30, which is screwed into an internally threaded spring washer 31 supported on the piston 11'. The screw 30 rests with its head on an externally threaded sleeve 32, which is screwed into a further internally threaded spring washer 33 and oriented at the end of the screw 30 opposite the spring washer 31. A flange on the threaded sleeve 32 is supported on a crosswall of the housing 6' and the head thereof extends through a bore in the wall. The spring washer 33 has a laterally projecting extension projecting into a recess 6'*a* of the housing, which recess 6'*a* is elongated in a longitudinal direction of the ski and is provided with a scale. This construction thus prevents a rotation of the spring washer while simultaneously indicating the adjusted initial tension of the spring.

A transverse crossbore, in which an axle 14' is supported, is provided in the extension 8' of the housing 6' at a location oriented above the bore 9'. A sole holder 15' is hingedly supported on the axle 14', which sole holder 15' has a stepping spur 16' rigidly connected thereto. The sole holder 15' has a cam surface 18' on an interior portion thereof, which cam surface 18' influences the vertical release of the heel holder 3'.

An intermediate, member 19' is furthermore supported at its upper end on the axle 14'. The intermediate member 19' engages on one side thereof which is the right side in FIG. 6, a face of the piston 10' and has an axle 21' thereon at its lower end. An intermediate lever 22' is supported on the axle 21', which intermediate lever 22' engages on the one side thereof the inner piston 11' and on the other side a locking lever 23'. The locking lever 23' is supported on an axle 24' which extends through the extensions 8' of the housing 6'.

In contrast to the first exemplary embodiment, the intermediate member 19' in the heel holder 3' carries a downwardly projecting axle 19'*a* on which a roller 7' is supported and which rolls along the cam surface on the member 4'. A further difference between both embodiments is that the intermediate member 19' has two cam surfaces 19'*b* on the side thereof facing the housing 6'. The cam surfaces 19'*b* engage the face of the piston 10', which face extends perpendicularly with respect to the axis of the bore 9'. Another difference consists in the release lever 17' being supported on an axle 34 anchored in the area of the upper end of the locking lever 23'. The release lever 17' is constructed approximately U-shaped in cross section.

The function of the heel holder 3' corresponds substantially with the first exemplary embodiment. With reference to the possibility of adjusting the initial tension of the two pressure springs 12' and 13', the initial tension of the inner spring 13' is changed by rotating the screw 30. If, however, the threaded sleeve 32 is rotated, then the initial tension of the two springs 12' and 13' are changed, especially since both springs are supported at their right ends (see FIG. 6) on the spring washer 33.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a safety ski binding comprising a sole plate pivotally supported in a horizontal plane about a vertically upright axle fixed to a ski, means for preventing said sole plate from lifting off from said ski, said sole plate having at its front end a front jaw and at its rear end a heel holder provided with a housing, said heel holder having a sole holder pivotally supported on said housing about a first transversely extending axle against the force of a first spring means, said heel holder further having a control lever means movably supported thereon and on which is provided a roller, and a second spring means for resisting movement of said control lever means, a curved surface mounted on a ski-fixed member and being engaged by said roller for controlling the lateral pivoting movement of said sole plate about said vertically upright axle, said first and second spring means being in a coaxial nested relation in a bore in said housing, and extension means for securing said housing to said sole plate, the improvement comprising wherein said first transversely extending axle is provided above said bore on at least one of the housing and said extension means, to said first transversely extending axle is hingedly secured an intermediate member, which in the area of its lower end a second transversely extending axle is provided and on which is supported an intermediate lever, said intermediate lever being pressed by both of said first and second spring means against a locking lever which, in turn, is pressed against a further cam surface provided on an inside facing portion of said sole holder, said locking lever being supported on said extension means for movement about a third transversely extending axle.

2. A binding according to claim 1, wherein said control lever is a two-arm lever, supports said roller on one arm thereof, and includes means for pivotally supporting said control lever on said third transversely extending axle.

3. A binding according to claim 2, wherein said roller is guided in a gap provided between said ski-fixed member having said cam surface on one side thereof and said sole plate on the other side, said sole plate having said heel holder on an upper side thereof.

4. A binding according to claim 1, wherein said control lever means is included as a part of said intermediate member.

5. A binding according to claim 4, wherein said ski-fixed member carrying said cam surface and which is engaged with said roller is a web portion of a base plate which is approximately U-shaped in cross section.

6. A binding according to claim 1, wherein said intermediate member has two cam surfaces which rest on a face of a piston loaded by said second spring means, said face extending perpendicularly with respect to an axis of said bore.

7. A binding according to claim 1, wherein said locking lever has an axle in its upper end area, on which axle is supported a release lever.

8. A binding according to claim 1, wherein an axis of each of said first and second spring means is arranged parallel with respect to an upper side of a ski.

* * * * *